US005218922A

United States Patent [19]

Kobayashi

[11] Patent Number: 5,218,922

[45] Date of Patent: Jun. 15, 1993

[54] JET PROPULSION WATERCRAFT

[75] Inventor: Noboru Kobayashi, Iwata, Japan

[73] Assignee: Yamaha Hatsudoki Kabushiki Kaisha, Iwata, Japan

[21] Appl. No.: 895,204

[22] Filed: Jun. 8, 1992

Related U.S. Application Data

[63] Continuation of Ser. No. 646,861, Jan. 28, 1991, abandoned.

[30] Foreign Application Priority Data

Jan. 29, 1990 [JP] Japan ..... 2-19805

[51] Int. Cl.[5] ..... B63B 17/00

[52] U.S. Cl. ..... 114/363; 114/361; 440/40

[58] Field of Search ..... 114/361, 343, 363; 440/84, 86, 87, 40–43

[56] References Cited

U.S. PATENT DOCUMENTS 2,775,218 12/1956 Kapusnyk ..... 114/343 X
3,478,712 11/1969 Fox ..... 440/43 X
3,786,892 1/1974 Horton ..... 440/84 X
3,823,431 7/1974 Miller ..... 114/361
3,839,757 10/1974 Grimes ..... 114/363
4,962,717 10/1990 Tsumiyama ..... 440/87 X

OTHER PUBLICATIONS

Vol. 1, Issue #2, "Hot Water" magazine, Jan. 1990, p. 33 and unnumbered page for product SurfRider.

*Primary Examiner*—Sherman Basinger
*Attorney, Agent, or Firm*—Ernest A. Beutler

[57] ABSTRACT

A seating arrangement for a small watercraft that will accommodate either an operator alone or with one, two or three passengers while maintaining side by side stability. The seating arrangement provides an operator's seat on the longitudinal center line of the watercraft, a passenger seat adapted to receive a single passenger to the rear of the operator's seat and seated in straddle fashion and a further pair of passengers seats spaced from the longitudinal center line and to the rear of the single passenger seat.

12 Claims, 4 Drawing Sheets

JET PROPULSION WATERCRAFT

This is a continuation of U.S. patent application Ser. No. 646,861, filed Jan. 28, 1991 and now abandoned.

BACKGROUND OF THE INVENTION

This invention relates to a jet propelled watercraft and more particularly to an improved passenger compartment and seating arrangement for a small watercraft that permits the maintenance of side by side balance regardless of whether an operator is operating the watercraft alone or whether is accompanied by one, two or more passengers.

A wide variety of small watercraft have been proposed for pleasure, sport or a wide variety of uses. These watercraft may be designed to handle only an operator or the operator with one or more riders. With a small watercraft that is designed to carry a varying number of passengers, however, there are problems in conjunction with the seating arrangement. For example, if bench type seats are employed it is the normal practice for the operator to be at one side of the forward most bench seat. This permits him to carry a single passenger and maintain side by side balance in the watercraft. However, if the operator operates the watercraft alone, then the watercraft will list toward the side where the operator is positioned resulting in unsatisfactory operation.

Alternatively, if the watercraft is operated by the rider seating in a central position, then problems in maintaining side by side balance can be encountered if the operator desires to accommodate either a single passenger or plural passengers.

It is, therefore, a principal object to this invention to provide an improved small watercraft and seating arrangement therefore.

It is a further object to this invention to provide a small watercraft having a seating arrangement which permits operation either by a single operator or by the operator and one or more passengers while maintaining side by side stability regardless of the number of individuals carried in the watercraft.

SUMMARY OF THE INVENTION

This invention is adapted to be embodied in a watercraft that is comprised of a hull and which has a propulsion unit carried by the hull for propelling the watercraft. The hull defines a passenger compartment and an operator's seat is positioned within the passenger compartment substantially on the longitudinal center line of the hull. Control means are provided for operating the watercraft and are accessible from the operator's seat. Passenger seat means are positioned within the passenger compartment to the rear of the operator's seat and to accommodate selected of a single rider or two or more riders. The passenger seat means are oriented to maintain side by side stability regardless of whether a single passenger or two or more passengers are carried along with the operator.

DETAILED DESCRIPTION OF THE PREFERRED EMBODIMENT OF THE INVENTION

Figure 1:
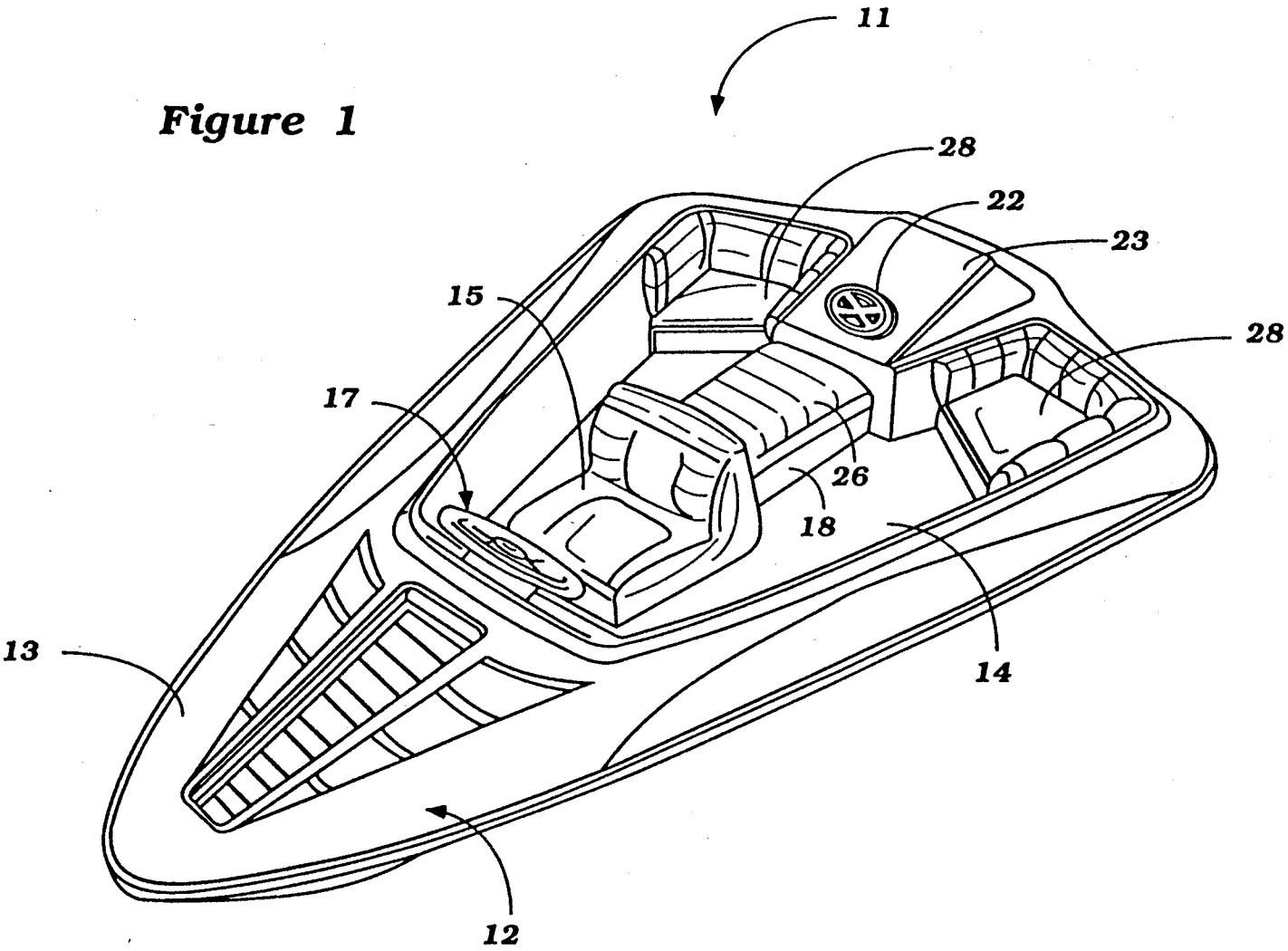
FIG. 1 is a perspective view of a small watercraft constructed in accordance with an embodiment of the invention taken from above and to one side thereof.
Figure 2:
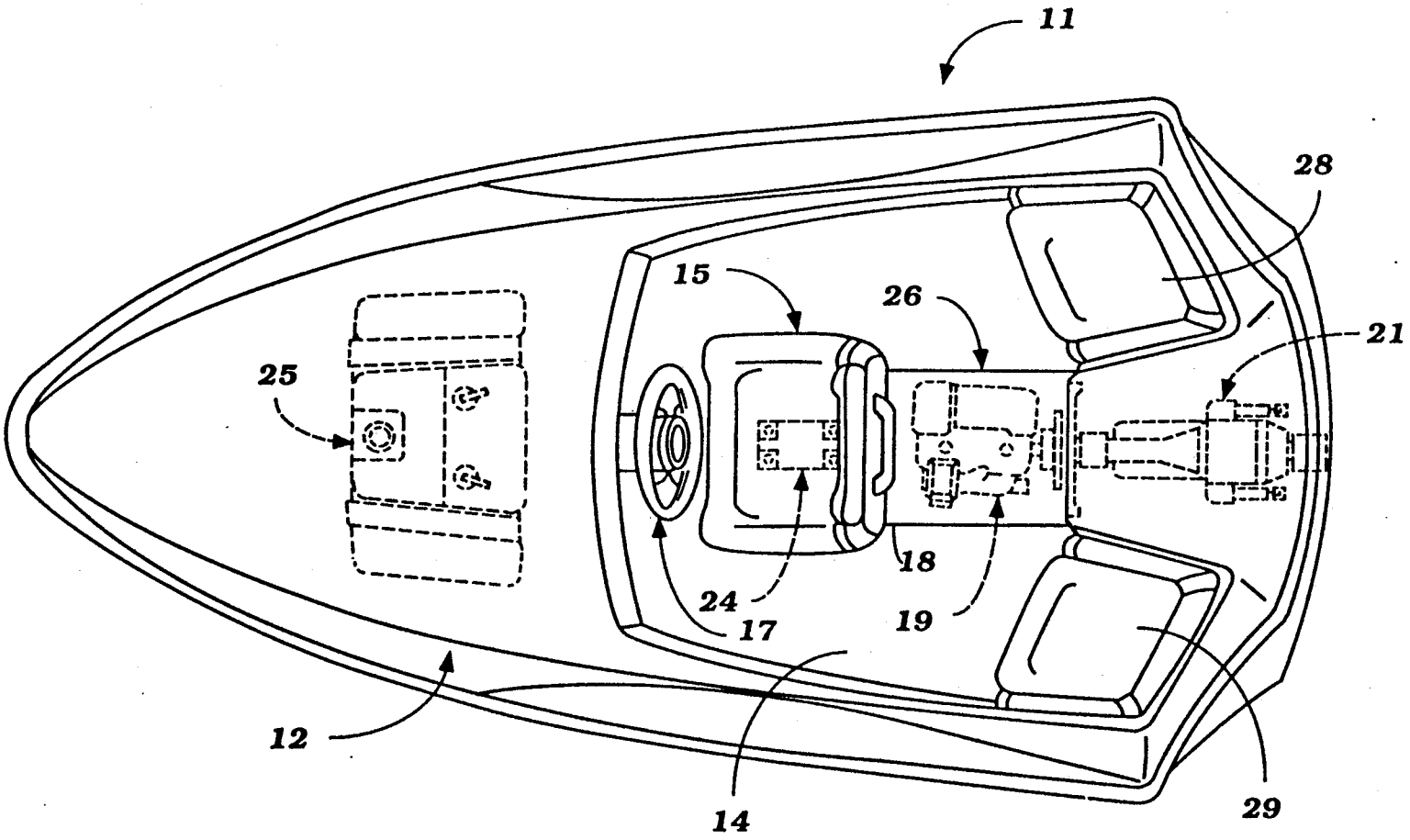
FIG. 2 is a top plan view of the small watercraft.
Figure 3:
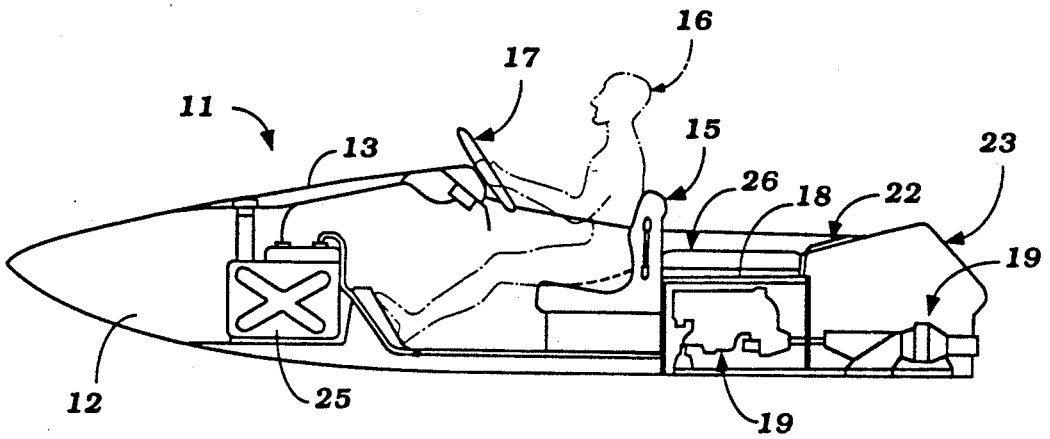
FIG. 3 is a side elevational view thereof, with portions shown in cross section, and showing how the operator can operate the watercraft alone.

In the drawings, the reference numeral 11 indicates generally a small watercraft constructed in accordance with an embodiment of the invention. The small watercraft is comprised of a hull, indicated generally by the reference numeral 12, which may be formed from a suitable material such as a molded fiberglass reinforced resin or the like. The hull 12 has a generally arrow shaped configuration when viewed in top plan and is provided with a forward storage area that is covered by a hatch 13. To the rear of the hatch 13, the hull is provided with a passenger compartment, indicated generally by the reference numeral 14 which has a more rectangular orientation although it is tapered somewhat toward the front.

Positioned at the front of the passenger compartment 14 is an operator's seat 15 having a cushion and a seat back which is designed so as to accommodate a single operator, indicated in phantom in certain of the views and identified by the reference numeral 16, that is seated in a normal type seating position much like being seated in a chair. Positioned in front of the operator's seat 15 are controls for the watercraft including a steering wheel 17. In addition, various other controls may be positioned in this forward area such as a speed control, transmission control, and the like.

A tunnel, indicated generally by the reference numeral 18 intrudes into the passenger compartment 14 to the rear of the operator's seat 15. Contained within this tunnel 18 is a powering internal combustion engine 19 which may be of any known type. To the rear of the tunnel 18 there is provided a further tunnel extension in which a jet propulsion unit 21 is positioned. The jet propulsion unit 21 is driven by the engine 19 in a known manner.

In a preferred form of the invention, the propulsion unit 21 may be of the type described in my co-pending application, entitled "Water Jet Propulsion Unit", Ser. No. 489 361, filed Mar. 6, 1990, now abandoned and refiled as Ser. No. 735,154, filed Jul. 22, 1991, a continuation thereof and assigned to the Assignee hereof. This type of jet propulsion unit is rotatable about a longitudinally extending axis and pivotal about a transversely extending axis for servicing and cleaning of its water inlet opening. This inlet opening when rotated and tilted will be accessible through an access opening 22 formed in a rear cover 23 of the hull 12 which is immediately adjacent the transom. Of course, the invention can be utilized in conjunction with other types of jet propulsion units or other types of propulsion units for watercraft than jet propulsion units including inboard/-outboard type drives, outboard motors or the like.

There may be certain auxiliary components for the engine 19 such as one or more storage batteries 24 which may be positioned under the operator's seat 15 and a forwardly positioned fuel tank 25 that is positioned beneath the hatch cover 13. The batteries 24 and fuel tank 25 are located on or close to the longitudinal center line of the watercraft so as to improve and maintain side to side balance so as to avoid any listing of the watercraft.

Figure 5:
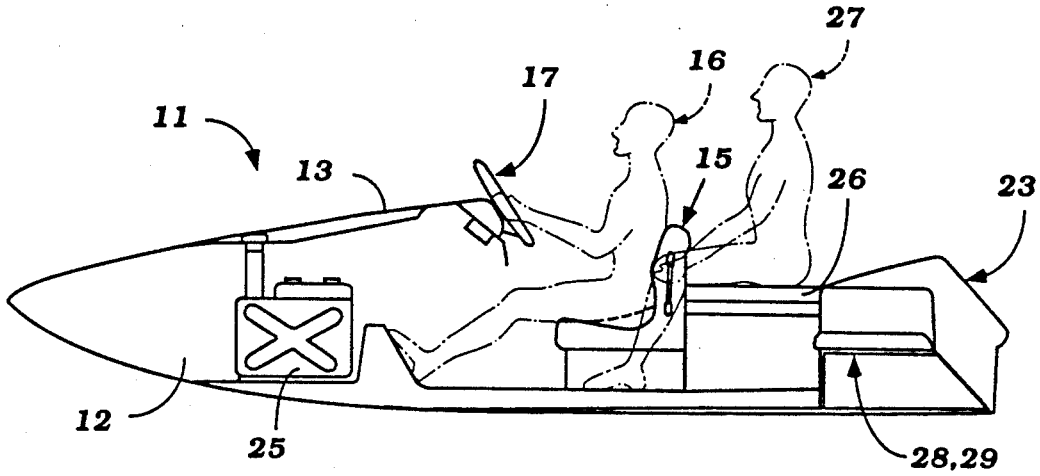
FIG. 5 is a side elevational view, in part similar to FIGS. 3 and 4, showing how the watercraft is operated by an operator accompanied by a single passenger.
Figure 6:
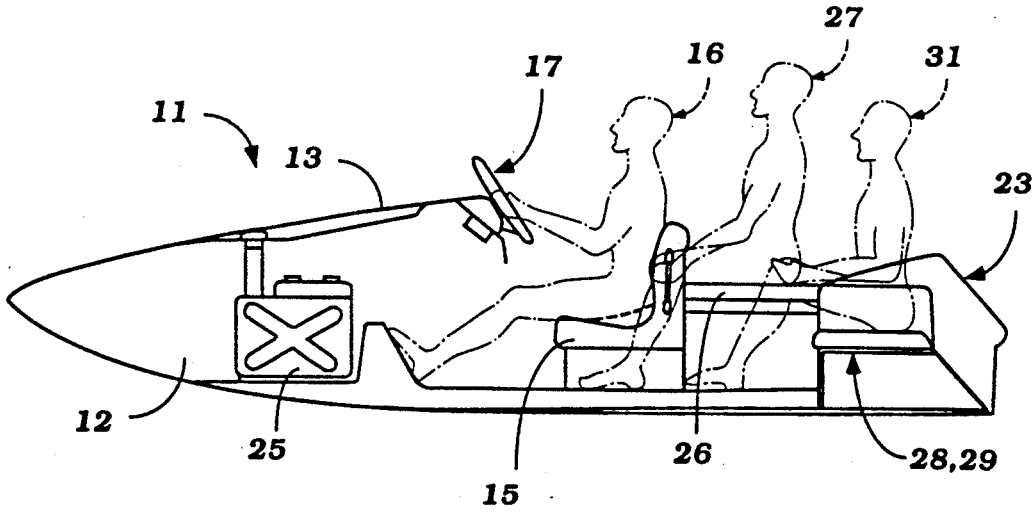
FIG. 6 is a side elevational view, in part similar to FIGS. 3 through 5, showing how the watercraft is operated with the operator and three passengers.

In accordance with a feature of the invention, a passenger seat 26 is positioned over the tunnel 18 and along the longitudinal center line of the watercraft. The seat 26 is designed so as to accommodate a single passenger seated in straddle fashion thereon immediately behind the operator 16 as shown in phantom and identified by the reference numeral 27 in FIGS. 5 and 6. Hence, the watercraft will be balanced from side to side regardless of whether the operator 16 is operating it alone or whether he is accompanied by a single rider.

Figure 4:
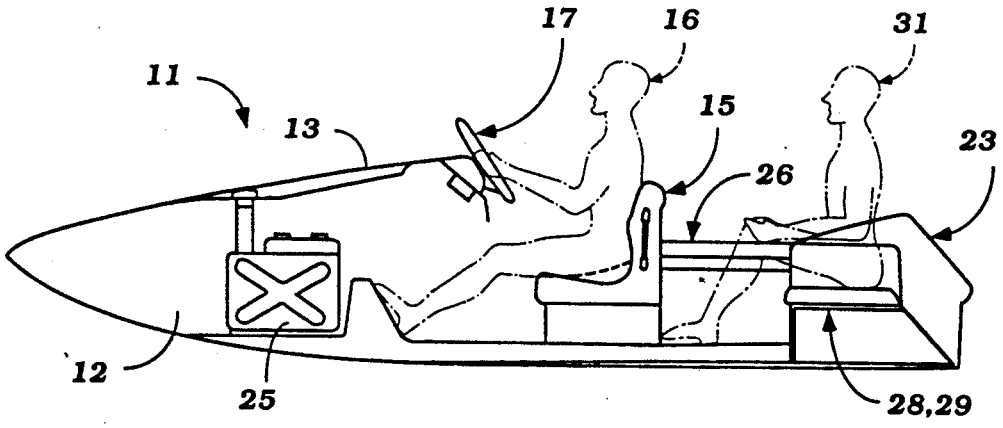
FIG. 4 is a side elevational view, in part similar to FIG. 3, showing how the watercraft may be operated with the operator and two passengers.

In addition, the rear deck 21 has on its opposite sides a pair of rear seats 28 and 29 which are formed behind the seat 26 and, of course, behind the operator's seat 15. The rear seats 28 and 29, like the driver's seat 15, have cushions and seat backs. A pair of riders shown in phantom and identified by the reference numeral 31 may be accommodated in side by side fashion in the seats 28 and 29 as shown in phantom in FIGS. 4 or 6. As a result of this configuration, the watercraft will be balanced regardless of whether the operator has a single passenger, two passengers or three passengers. Thus, side by side balance may be maintained in the watercraft without requiring shifting of the passengers or operator and regardless of whether the operator is alone or with one, two or three passengers.

It is to be understood that the foregoing description is that of a preferred embodiment of the invention and that various changes and modifications may be made without departing from the spirit and scope of the invention, as defined by the appended claims.

I claim:

1. A watercraft having a hull having an upper portion defining a passenger's area to the rear thereof, a propulsion unit contained within said hull for propelling said watercraft and contained at least in part in a raised area extending along the rear of said hull and lying substantially along its longitudinal center line within said passenger's area, first seating means providing a pair of seats at the rear of said hull and within said passenger's area for accommodating at least two riders on opposite sides of said raised area for maintaining side to side balance, and second seating means extending directly from said raised area forwardly of said pair of seats and between said pair of seats and along said longitudinal center line of said watercraft for accommodating at least two riders in tandem.

2. A watercraft as set forth in claim 1 wherein at least a portion of the second seating means is raised and extends over an area containing an internal combustion engine for the propulsion unit.

3. A watercraft as set forth in claim 1 where at least a portion of the second seating means accommodates its rider in straddle fashion.

4. A watercraft as set forth in claim 3 wherein the second seating means accommodates an operator at the front thereof and further comprising control means for the watercraft positioned in the front of the operator.

5. A watercraft as set forth in claim 4 wherein the second seating means further provides a seat back for the operator.

6. A watercraft as set forth in claim 5 wherein at least a portion of the second seating means is raised and extends over an area containing an internal combustion engine for the propulsion unit.

7. A watercraft as set forth in claim 1 wherein the propulsion unit comprises a jet pump propulsion unit under the raised area.

8. A watercraft as set forth in claim 7 wherein at least a portion of the second seating means is raised and extends over an area containing an internal combustion engine for the propulsion unit.

9. A watercraft as set forth in claim 7 where at least a portion of the second seating means accommodates its rider in straddle fashion.

10. A watercraft as set forth in claim 9 wherein the second seating means accommodates an operator at the front thereof and further comprising control means for the watercraft positioned in the front of the operator.

11. A watercraft as set forth in claim 10 wherein the second seating means further provides a seat back for the operator.

12. A watercraft as set forth in claim 11 wherein at least a portion of the second seating means is raised and extends over an area containing an internal combustion engine for the propulsion unit.

* * * * *